US005366845A

United States Patent [19]

Inoue et al.

[11] Patent Number: 5,366,845

[45] Date of Patent: Nov. 22, 1994

[54] SILVER HALIDE PHOTOGRAPHIC PHOTOSENSITIVE MATERIAL AND A METHOD OF PROCESSING SAME

[75] Inventors: Nobuaki Inoue; Seiichi Yamamoto; Takahiro Goto, all of Kanagawa, Japan

[73] Assignee: Fuji Photo Film Co., Ltd., Kanagawa, Japan

[21] Appl. No.: 139,847

[22] Filed: Oct. 22, 1993

[30] Foreign Application Priority Data

Oct. 22, 1992 [JP] Japan ..... 4-284562

[51] Int. Cl.[5] ..... G03C 1/06

[52] U.S. Cl. ..... 430/264; 430/510; 430/512; 430/523; 430/604; 430/963

[58] Field of Search ..... 430/264, 510, 512, 523, 430/604, 963

[56] References Cited

U.S. PATENT DOCUMENTS

| | | | |
|---|---|---|---|
| 4,092,168 | 5/1978 | Lemahieu et al. | 430/510 |
| 4,904,565 | 2/1990 | Schmidt et al. | 430/264 |
| 4,980,276 | 12/1990 | Arai et al. | 430/510 |
| 5,004,669 | 4/1991 | Yamada et al. | 430/264 |
| 5,077,185 | 12/1991 | Cho et al. | 430/510 |
| 5,104,777 | 4/1992 | Schmidt et al. | 430/510 |
| 5,213,954 | 5/1993 | Shor et al. | 430/512 |

*Primary Examiner*—Thomas R. Neville

*Attorney, Agent, or Firm*—Sughrue, Mion, Zinn, Macpeak & Seas

[57] ABSTRACT

A silver halide photographic photosensitive material comprising a support, at least one silver halide emulsion layer on the support, a non-photosensitive hydrophilic colloid layer provided between the support and the at least one silver halide emulsion layer, and a backing layer provided on the side of the support which is opposite to the side having the at least one silver halide emulsion layer; wherein (a) the at least one silver halide emulsion layer contains silver halide grains having a grain size of not more than 0.2 μm, and a silver chloride content of at least 90 mol %, (b) the non-photosensitive hydrophilic colloid layer contains a dye solid-dispersed in the form of fine crystals in the range of from 10–80 mg/m$^2$, and (c) the backing layer has an absorbance at 340–380 nm of from 0.30–0.90. A method for processing the silver halide photographic photosensitive material is also disclosed.

12 Claims, No Drawings

SILVER HALIDE PHOTOGRAPHIC PHOTOSENSITIVE MATERIAL AND A METHOD OF PROCESSING SAME

FIELD OF THE INVENTION

This invention is directed to a photographic photosensitive material which can be employed in the photographic plate-making process known as dot to dot work and, in particular, it is directed to a silver halide photographic photosensitive material for daylight contact work which exhibits improved photographic characteristics.

BACKGROUND OF THE INVENTION

For dealing with the diversity and complexity of printed material, improvement in the operational efficiency of the photographic plate-making operation in the field of print reproduction is desired.

In particular, improvement in the operational efficiency when compositing and contact work are carried out in a relatively lighter environment has been desired, and progress has been made with the development of silver halide photographic photosensitive materials for plate making purposes which essentially can be handled in environments known as light rooms and with the development of exposing printers.

The silver halide photographic photosensitive material for light room purposes described herein is a photographic photosensitive material with which light of wavelength of 400 nm or more, which does not include an ultraviolet component, can be employed as safelight lighting.

In recent years, concern over environmental problems has increased universally, and there has been a great demand for a reduction in the rate of replenishment of developers and fixers in the systems which are used for the processing of sensitive materials. Reduction of the coated silver weight of the photosensitive material is one means of reducing the rate of replenishment, but this gives rise to problems such as a reduced maximum density ($D_{max}$). Reducing the grain size of the silver halide emulsion and increasing the covering power are means of obtaining a high $D_{max}$ with a small amount of silver and, since there is no need to increase the photographic speed, research has been conducted to reduce the grain size in high silver chloride emulsions for light room contact type sensitive materials. Disclosures have been made in JP-A-63-183438, JP-A-63-296034, JP-A-63-306436, JP-A-l-108123, JP-A-4-14033, JP-A-4-122923, JP-A-4-127143, and U.S. Pat. Nos. 4,659,647 and 5,104,777 in connection with fine grain silver chloride emulsions. (The term "JP-A" as used herein means an "unexamined published Japanese patent application".)

When the fine grain emulsion $D_{max}$ is increased and, with the advantage of reducing the amount of silver, the transparency of the film is increased and problems arise due to the occurrence in halation of the transmitted light in operations such as the dry dot (which is a characteristic feature of the contact field), and due to a marked deterioration in tone reproduction. There are methods in which the amount of backing dye is increased or in which an antihalation (AH) layer is introduced for solving these problems, but when dyes are added to solve these problems, further problems arise such as residual coloration on rapid processing and a marked reduction in photographic speed on exposure from the reverse side.

Methods in which acidic dyes which have sulfo groups or carboxyl groups are localized in a specified layer using a mordant were known in the past as a means of fixing dyes in an anti-halation layer. The polymers of ethylenic unsaturated compounds which have dialkylaminoalkylester residual groups disclosed in British Patent 685,475, the reaction products of poly(vinyl alkyl ketone) and aminoguanidine disclosed in British Patent 850,281, and the vinylpyridine polymers and vinylpyridinium cationic polymers disclosed in U.S. Pat. Nos. 2,548,564, 2,484,430, 3,148,061 and 3,756,814 are known, for example, as mordants of this type. Further, cationic mordants in which secondary or tertiary amino groups, nitrogen-containing heterocyclic groups or quaternary cations (based on these groups) are included in the polymer can be used for effectively mordanting the acid dyes.

However, diffusion of these acidic dyes into other layers is frequently observed with mordants of this type. The use of a large quantity of mordant has been considered for preventing the occurrence of this diffusion, but it is not possible to stop diffusion completely. Furthermore, the thickness of the layer in which the dye should be included is increased and, as a result, new disadvantages arise. Moreover, the operation known as reduction (in which a reducer is used, for example, to adjust density or gradation) is frequently conducted with sensitive materials for printing plate making purposes and a water soluble iron complex is included in the reducer as an active ingredient. When a cationic mordant, as described above, has been used, disadvantageously, electrostatic bonding occurs with the iron complex and yellow staining by the iron complex occurs as a result.

Furthermore, the inclusion of a dye as a dispersed solid as disclosed in JP-A-56-12639, JP-A-55-155350, JP-A-55-155351, JP-A-52-92716, JP-A-59-193447, JP-A-62-198148, JP-A-63-197943, JP-A-63-27838, JP-A-64-40827, European Patents 0015601B1 and 0276566A1, International Application laid open 88/04794, JP-A-2-277045, JP-A-4-14033, JP-A-4-127143 and U.S. Pat. No. 510,4777 is known as another means of retaining the dye in a specified layer within a photographic photosensitive material.

SUMMARY OF THE INVENTION

Hence, an object of the present invention is to provide a silver halide photographic photosensitive material for light room use which has a reduced silver content and the characteristic performance required of a contact sensitive material, that is, dry dot suitability and tone variability, and with which there is little residual coloration even on rapid processing.

Accordingly to the present invention there is provided a silver halide photographic photosensitive material comprises a support, at least one silver halide emulsion layer provided on said support, a non-photosensitive hydrophilic colloid layer provided between said support and said at least one silver halide emulsion layer, and a backing layer containing a dye provided on the side of said support which is opposite to the side having said at least one silver halide emulsion layer; wherein (a) said at least one silver halide emulsion layer contains silver halide grains having an average grain size of not more than 0.2 μm, and a silver chloride content of at least 90 mol %, (b) said non-photosensitive hydrophilic colloid layer contains a dye which is solid-dispersed in the form of fine crystals and is coated in an amount of from 10–80 $mg/m^2$, and (c) said dye contained in said backing layer has an absorbance at 340–380 nm of from 0.30–0.90.

Also, according to the present invention a method of processing a silver halide photographic photosensitive material comprises processing the silver halide photographic photosensitive material with a total dry to dry processing time of 30–60 seconds.

DETAILED DESCRIPTION OF THE INVENTION

The dyes in Tables I to X of International Patent WO88/04794, (I)–(VII), indicated below, and others known in the art such as those disclosed in patents & patent applications listed below can be used for the dyes which can be solid dispersed in a fine crystalline form in the present invention.

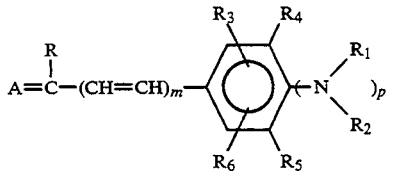

(I)

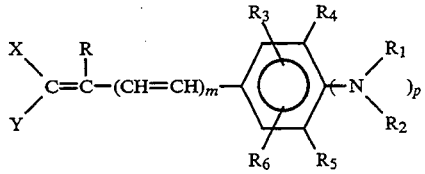

(II)

$$A{=}L_1{-}(L_2{=}L_3)_n{-}A' \quad \text{(III)}$$

$$A{=}(L_1{-}L_2)_{2-q}{=}B \quad \text{(VI)}$$

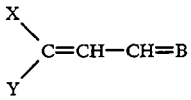

(V)

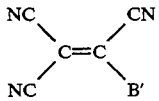

(VI)

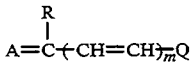

(VII)

In these formulae, A and A', which may be the same or different, each represents an acidic nucleus, B represents a basic nucleus, and X and Y, which may be the same or different, each represents an electron withdrawing group. R represents a hydrogen atom or an alkyl group, $R_1$ and $R_2$ each represents an alkyl group, an aryl group, an acyl group or a sulfonyl group, and $R_1$ and $R_2$ may be joined together to form a five- or six-membered ring. $R_3$ and $R_6$ each represents a hydrogen atom, a hydroxy group, a carboxyl group, an alkyl group, an alkoxy group or a halogen atom, and $R_4$ and $R_5$ each represents a hydrogen atom, or a group of non-metal atoms which is required for $R_1$ and $R_4$ or $R_2$ and $R_5$ to be joined together to form a five- or six-membered ring. $L_1$, $L_2$ and L3 each represents a methine group. Moreover, m represents 0 or 1, n and q each represents 0, 1 or 2, p represents 0 or 1, and, when p is 0, then $R_3$ represents a hydroxy group or a carboxyl group and $R_4$ and $R_5$ each represents a hydrogen atom. B' represents a heterocyclic group which has a carboxyl group, a sulfamoyl group or a sulfonamido group. Q represents a heterocyclic group.

However, the compounds represented by formulae (I)–(VII) have within the molecule at least one dissociable group having a pKa value in the range of 4–11 in a 1 : 1 by volume mixed solution of water and ethanol.

The dyes disclosed, for example, in International Patent WO88/04794, European Patents (EP) 0274723A1, 276566 and 299435, JP-A-52-92716, JP-A-55-155350, JP-A-55-155351, JP-A-61-205934, JP-A-48-68623, U.S. Pat. Nos. 2,527,583, 3,586,897, 3,746,539, 3,933,798, 4,130,429 and 4,040,841, and Japanese Patent Application Nos. H1-50874, H1-103751, H1-307363 and H1-301259 can be used in practice as the dyes which can be used in the solid dispersion. Methods of dispersion have also been disclosed in the abovementioned patents, and the dyes may be made into dispersed solids mechanically in water together with an appropriate solvent using a ball mill, a sand mill or a colloid mill, or a fine solid precipitate can be obtained by dissolving a dye in an aqueous alkaline solution by adjusting the pH so that the dye is dissolved and then reducing the or a dispersed solid can be obtained by dissolving a dye in a suitable solvent and then adding a solvent (in which the dye is insoluble) to precipitate the dye.

In the present invention, the preferred dyes are those which have a peak absorption in the range of 300–500 nm. Actual examples of dyes are given below. However, the invention is not limited to the compounds given below.

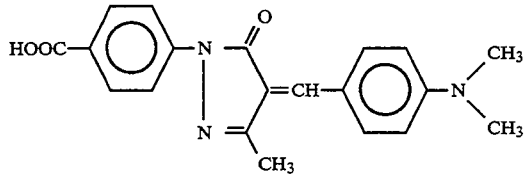

I-1

-continued
I-2
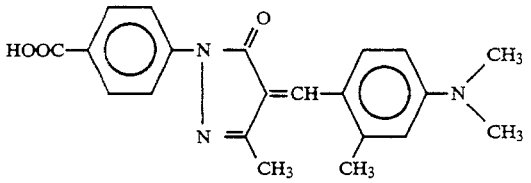
I-3
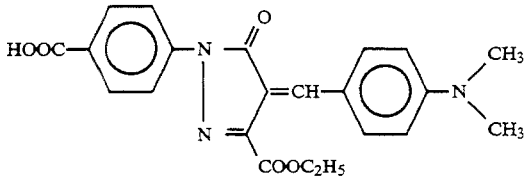
I-4
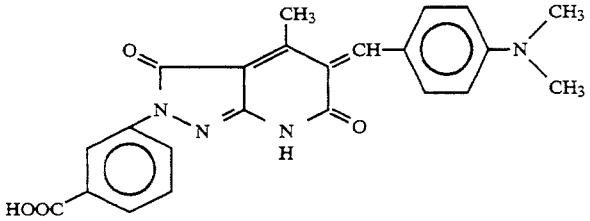
II-1
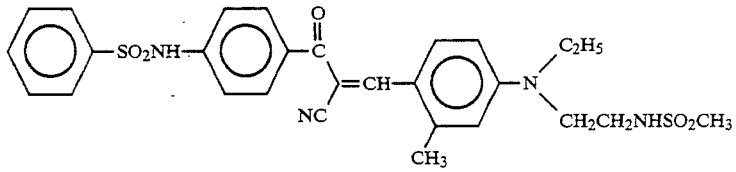
III-1
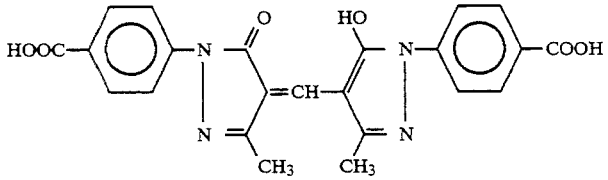
III-2
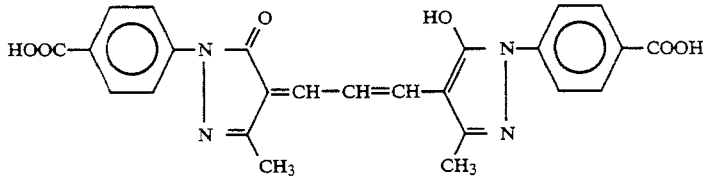
III-3
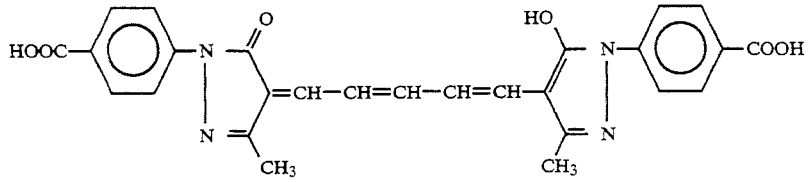
III-4
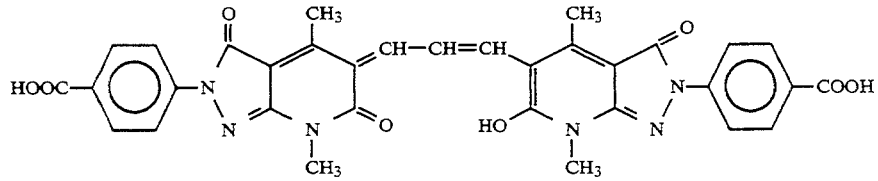

-continued

III-5

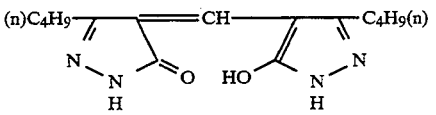

IV-1

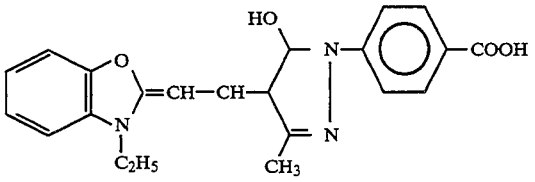

V-2

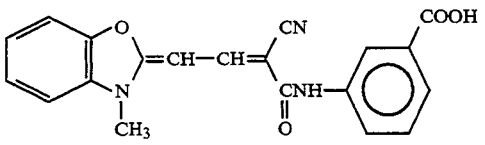

VI-1

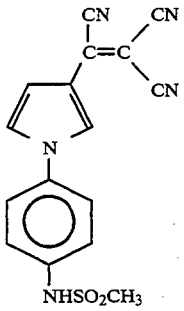

VII-1

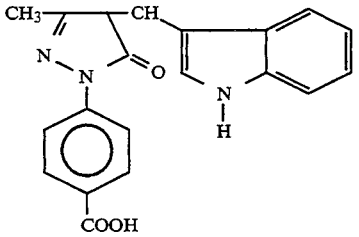

VII-2

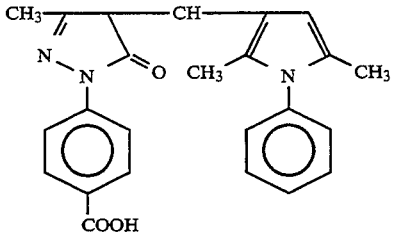

The dye, which has been solid dispersed in the form of fine crystals in the present invention, is added to a non-photosensitive hydrophilic colloid layer (or anti-halation layer) between the emulsion layer and the support layer with a view to establishing both dry dot suitability and fine grain silver economy. The coated weight of the dye is from 10 mg to 80 mg, and, most desirably, from 20 mg to 60 mg per square meter.

The dyes which are used in the present invention can be prepared easily using the methods disclosed, for example, in International Patent W088/04794, European Patents EP0274723A1, 276566 and 299435, JP-A-52-92716, JP-A-55-155350, JP-A-55-155351, JP-A-61-205934, JP-A-48-68623, U.S. Pat. Nos. 2,527,483, 3,486,897, 3,746,539, 3,933,798, 4,130,429 and 4,040,841, Japanese Patent Application No. H1-50874, JP-A-2-282244 and JP-A-3-167546.

Protective layers can be formed on both the backing layer and the at least one silver halide emulsion layer. The silver halide photographic photosensitive material of the present invention preferably contains a solid dispersed dye in the protective layer(s) so that it can be handled in a light room from which ultraviolet light has been reduced, and tone variability or the spread and choke suitability are improved.

Furthermore, a dye is included in the backing layer in order to ensure safelight safety and external light safety from the backing layer side, but no limitation is imposed on the dye, e.g., the dye may be a water soluble dye or a solid dispersed dye. However, water soluble dyes are preferred for the dye which is included in the backing layer. The coated weight of the dye in the backing layer is preferably in the range of from 50 mg to 1000 mg per square meter, and the absorbance at 340 nm–380 nm is within the range of 0.30–0.90 and, preferably, within the range 0.4–0.8.

The at least one silver halide emulsion layer may contain a dye which has been solid-dispered in the form of fine crystals or a water soluble dye. The water soluble dyes which can be used in the present invention have a principal absorbance in the visible wavelength region in the intrinsic photosensitive wavelength region of the silver halide emulsion which is being used. From among these dyes, those which have $\lambda_{max}$ in the range from 350 nm to 600 nm are preferred. No particular limitation is imposed upon the chemical structure of the dye, and use can be made, for example, of oxonol dyes, hemioxonol dyes, merocyanine dyes, cyanine dyes and azo dyes.

Specifically, the pyrazolone dyes disclosed in JP-B-58-12576, the pyrazolone oxonol dyes disclosed in U.S. Pat. No. 2,274,782, the diaryl azo dyes disclosed in U.S. Pat. No. 2,956,879, the styryl dyes and butadienyl dyes disclosed in U.S. Pat. Nos. 3,423,207 and 3,384,487, the merocyanine dyes disclosed in U.S. Pat. No. 2,527,583, the merocyanine dyes and oxonol dyes disclosed in U.S. Pat. Nos. 3,486,897, 3,652,284 and 3,718,472, the enaminohemioxonol dyes disclosed in U.S. Pat. No. 3,976,661, and the dyes disclosed in British Patents 584,609 and 1,177,429, JP-A-48-85130, JP-A-49-99620, JP-A-49-114420 and U.S. Pat. Nos. 2,533,472, 3,148,187, 3,177,078, 3,247,127, 3,540,887, 3,575,704 and 3,653,905 can be used. (The term "JP-B" as used herein means an "examined Japanese patent publication".) The amount of the dye which is solid dispersed in the form of fine crystals or the water soluble dye is preferably added in an amount such that the lowering of photographic speed in terms of log E by the dye does not exceed 0.2, and it is, for example, from 5 to 100 mg/m$^2$.

The silver halide emulsion in the silver halide photographic photosensitive material has an average grain size of not more than 0.20 μm. Those with an average grain size of 0.08–0.16 μm are preferred. If the grain size exceeds 0.2 μ, gamma is reduced and the $D_{max}$ in photographic practice is also reduced. Furthermore, the silver in said at least one silver halide emulsion layer is preferably coated in an amount of not more than 3.2 g/m$^2$ and, more preferably, not more than 3.0 g/m$^2$.

In the preparation of silver halide grains to be used in the present invention, good results can be obtained if the mixing conditions are set such that the reaction temperature is at least 50° C., and preferably at least 40° C., with agitation at a sufficiently high rate to ensure uniformmixing with a silver potential of at least 70 mV, and preferably 300 mV–500 mV, or with adjustment to 80 mV–120 mV in the presence of a stabilizer such as 5,6-cyclopentane-4-hydroxy-1,3,3*a*,7-tetraazaindene.

No particular limitation is imposed upon the grain size distribution, but a mono-dispersion is preferred. Here, a mono-dispersion is comprised of a collection of grains of which at least 95% of the grains by number or by weight have a size within ±40% and, most desirably, within ±20%, of the average grain size.

The silver halide grains of the present invention preferably have a regular crystalline form such as a cubic or octahedral form, and a cubic form is especially desirable. Furthermore, the inclusion of transition metals within the silver halide grains is desirable.

The preferred forms of the transition metals for use in the present invention are transition metal coordination complexes, and the hexa-coordinate complexes indicated by the following formula:

$$[M(NY)_mL_{6-m}]^n$$

M in this formula is a transition metal selected from among the elements of groups V–VIII of the periodic table. L is a bridging ligand. Y is oxygen or sulfur. Moreover, m=0, 1, or 2, and n=0, −1, −2, or −3.

Preferred specific examples of L include halogen ligands (fluoride, chloride, bromide and iodide), cyanide ligands, cyanate ligands, thiocyanate ligands, selenocyanate ligands, tellurocyanate ligands, azido ligands and aquo ligands. In those cases where aquo ligands are present they preferably account for one or two of the ligands.

The most desirable specific examples of M are rhodium, ruthenium, rhenium, osmium and iridium.

Specific examples of transition metal coordination complexes are given below.

1. $[Rh(H_2O)Cl_5]^{-2}$
2. $[RuCl_6]^{-3}$
3. $[Ru(NO)Cl_5]^{-2}$
4. $[RhCl]_6]^{-3}$
5. $[Ru(H_2O)Cl_5]^{-2}$
6. $[Ru(NO)(H_2O)Cl_4]^{-1}$
7. $[Re(NO)Cl_5]^{-2}$
8. $[Os(NO)Cl_5]^{-2}$
9. $[Ir(No)Cl_5]^{-2}$
10. $[Ir(H_2O)Cl_5]^{-2}$
11. $[Re(H_2O)Cl_5]^{-2}$
12. $[RhBr_6]^{-2}$
13. $[Os(NS)Cl(SCN)_4]^{-2}$
14. $[ReCl_6]^{-3}$
15. $[IrCl_6]^{-3}$
16. $[Re(NS)Cl_4(SeCN)]^{-2}$

The abovementioned metal complexes can be added during grain formation for inclusion in the silver halide.

The content of the transition metals in the silver halide grains of the present invention is generally at least $10^{-7}$ mol, preferably $10^{-6}-5\times10^{-4}$ mol, and most desirably $5\times10^{-6}-2\times10^{-4}$ mol, per mol of silver halide. Furthermore, the abovementioned transition metals may be used conjointly.

No particular limitation is imposed upon the distribution of the transition metal in the silver halide grains, but the inclusion of a larger amount in the outer parts of the grain is preferred.

The silver halide emulsion of the silver halide photographic photosensitive material may contain silver chlorobromide or silver chloroiodobromide. The silver halide grains contain at least 90 mol % silver chloride. Where silver chlorobromide or silver chloroiodobromide are used as the silver halide grains, increasing the proportion of silver bromide or silver iodide (such that the amount of silver chloride is less than 90 mol %) has an adverse effect on the safelight safety in a light room, or results in a reduction of gamma, which is undesirable.

The silver halide emulsions which are used in the method of the present invention may or may not have been subjected to chemical sensitization. Sulfur sensitization, reduction sensitization and precious metal sensitization are known as methods for the chemical sensitization of silver halide emulsions, and any of these methods can be used independently, or chemical sensitization can be carried out using these methods conjointly.

Gold sensitization is typical of precious metal sensitization, and gold compounds, principally, gold complex salts, are used in this case. Precious metals other than gold, for example, platinum, palladium and iridiumcomplex salts, can also be included. Actual examples have been disclosed, for example, in U.S. Pat. No. 2,448,060 and British Patent 618,061.

As well as the sulfur compounds which are contained in gelatin, various sulfur compounds, such as thiosulfate, thioureas, thiazoles and rhodanines, for example, can be used as sulfur sensitizing agents.

Stannous salts, amines, formamidinesulfinic acid and silane compounds, for example, can be used as reduction sensitizing agents.

Inorganic or organic gelatin hardening agents can be included in the photographic emulsions and the non-photosensitive hydrophilic colloids in the present invention.

For example, active vinyl compounds (such as 1,3,5-triacryloyl-hexahydro-s-triazine, bis(vinylsulfonyl)-methyl ether, N,N-methylenebis-[β-(vinylsulfonyl)propionamide]), active halogen compounds (such as 2,4-dichloro-6-hydroxy-s-triazine), mucohalogen acids (such as mucochloric acid) N-carbamoylpyridinium salts (such as (1-morpholyl)carbonyl-3-pyridino)methanesulfonate) and haloamidinium salts ( such as 1-(1-chloro-1-pyridinomethylene)pyrrolidinium 2-naphthalenesulfonate) may be used, either individually or in combination. From among these compounds, the active vinyl compounds disclosed in JP-A-53-41220, JP-A-53-57257, JP-A-59-162546 and JP-A-60-80846, and the active halogen compounds disclosed in U.S. Pat. No. 3,325,287, are preferred.

A variety of surfactants may be included for various purposes in the at least one photographic emulsion layer or other hydrophilic layers. For example, such surfactants may be included as coating promotors or as antistatic agents, for improving slip properties, for emulsification and dispersion purposes, for the prevention of sticking and for improving photographic performance (for example, accelerating development, increasing contrast or increasing photographic speed).

Furthermore, use can be made of non-ionic surfactants such as saponin (steroid based), alkylene oxide derivatives (for example, polyethylene glycol, polyethylene glycol/polypropylene glycol condensate, polyethylene glycol alkyl ethers or polyethylene glycol aryl alkyl ethers, polyethylene glycol esters, polyethylene glycol sorbitan esters, polyalkylene glycol alkyl amines or amides and poly(ethylene oxide) adducts of silicones), glycidol derivatives (for example, alkenylsuccinic acid polyglyceride, alkylphenol polyglyceride), fatty acid esters of polyhydric alcohols and the alkyl esters of sugars; anionic surfactants which include acidic groups, such as carboxy groups, sulfo groups, phospho groups, sulfate ester groups and phosphate ester groups (for example, alkylcarboxylates, alkylsulfonates, alkylbenzene-sulfonates, alkylnaphthalenesulfonates, alkylsulfate esters, alkylphosphate esters, N-acyl-N-alkyltaurines, sulfosuccinate esters, sulfoalkylpolyoxyethylene alkylphenyl ethers and polyoxyethylenealkylphosphate esters); amphoteric surfactants such as amino acids, aminoalkylsulfonic acids, aminoalkyl sulfate or phosphate esters, alkylbetaines and amine oxides; and cationic surfactants such as alkylamine salts, aliphatic and aromatic quaternary ammoniumsalts, heterocyclic quaternary ammonium salts, for example, pyridinium salts, imidazolium salts, and aliphatic or heterocyclic ring-containing phosphonium or sulfonium salts.

Furthermore, the use of fluorine containing surfactants disclosed, for example, in JP-A-60-80849 is desirable for antistatic purposes.

To prevent the occurrence of sticking, matting agents such as silica, magnesium oxide and poly(methyl methacrylate) can be included in the photographic emulsion layers or other hydrophilic colloid layers in the photographic photosensitive material of the present invention.

For dimensional stability, dispersions of water insoluble or sparingly soluble synthetic polymers can be included in the photosensitive material of the present invention. For example, polymers in which alkyl (meth)acrylate, alkoxyalkyl (meth)acrylate and glycidyl (meth)acrylate either alone or in combination, or combinations of these with acrylic acid and methacrylic acid, form the monomer components can be used.

The use of gelatin as a condensing agent or protective colloid in a photographic emulsion is effective, but other hydrophilic colloids can also be used, such as: graft copolymers of gelatin and other polymers and proteins such as albumin and casein; cellulose derivatives such as carboxyethylcellulose, carboxymethylcellulose and cellulose sulfate esters, and sodium alginate and sugar derivatives such as starch derivatives; and various synthetic water soluble polymeric materials such as homopolymers or copolymers of poly(vinyl alcohol), partially acetylated poly(vinyl alcohol), poly(N-vinylpyrrolidone), poly(acrylic acid), poly(methacrylic acid), polyacrylamide, polyvinylimidazole and polyvinylpyrazole.

Types of gelatin include lime treated gelatin, acid treated gelatin, gelatin hydrolysis products, and enzyme degradation products of gelatin.

A polymer latex, such as an alkyl acrylate latex, can be included in the silver halide emulsion layer used in the present invention.

Cellulose triacetate, cellulose diacetate, nitrocellulose, polystyrene and poly(ethylene terephthalate), paper, baryta coated paper or polyolefin coated paper, for example, can be used as the support in the photosensitive material of the present invention.

No particular limitation is imposed on the developing agent used in the developer of the present invention, but the inclusion of dihydroxybenzenes is desirable from the viewpoint of readily obtaining good screen dot quality, and there are also cases in which combinations of dihydroxybenzenes and 1-phenyl-3-pyrazolidones and combinations of dihydroxybenzenes and p-aminophenols are used.

Hydroquinone, chlorohydroquinone, bromohydroquinone, isopropylhydroquinone, methylhydroquinone, 2,3-dichlorohydroquinone, 2,5-dichlorohydroquinone, 2,3-dibromohydroquincne and 2,5-dimethylhydroquinone, for example, are especially desirable as dihydroxybenzene developing agents which are used in the present invention.

The 1-phenyl-3-pyrazolidone and developing agents derived therefrom which are used in the present invention, include 1-phenyl-3-pyrazolidone, 1-phenyl-4,4-dimethyl-3-pyrazolidone, 1-phenyl-4-methyl-4-hydroxymethyl-3-pyrazolidone, 1-phenyl-4,4-dihydroxymethyl-3-pyrazolidone, 1-phenyl-5-methyl-3-pyrazolidone, 1-p-aminophenyl-4,4-dimethyl-3-pyrazolidone, 1-p-tolyl-4,4-dimethyl-3-pyrazolidone and 1-p-tolyl-4-methyl-4-hydroxymethyl-3-pyrazolidone.

N-Methyl-p-aminophenol, p-aminophenol, N-(β-hydroxyethyl)-p-aminophenol, N-(4-hydroxyphenyl)g-lycine, 2-methyl-p-aminophenol and p-benzylaminophenol are, for example, p-aminophenol based developing agents which can be used in the present invention. The use of N-methyl-p-aminophenol is particularly preferred.

Use of the developing agent in an amount of from 0.05 mol/liter to 0.8 mol/liter is generally desirable. Furthermore, in those instances where combinations of dihydroxybenzenes and 1-phenyl-3-pyrazolidones or p-aminophenols are used, the dihydroxybenzenes are preferably used in amounts of from 0.05 mol/liter to 0.5 mol/liter and the 1-phenyl-3-pyrazolidones or p-aminophenols are preferably used in amounts of not more than 0.06 mol/liter.

Sodium sulfite, potassium sulfite, lithium sulfite, ammonium sulfite, sodium bisulfite, potassium metabisulfite and formaldehyde/Sodium bisulfite, for example, can be used as the sulfite preservative in the present invention. The sulfite is preferably included in an amount of at least 0.3 mol/liter, and more desirably in an amount of at least 0.4 mol/liter. Preferably, the amount of sulfite does not exceed 2.5 mol/liter, more preferably, the amount of sulfite does not exceed 1.2 mol/liter.

Moreover, pH controlling agents and buffers, such as sodium hydroxide, potassium hydroxide, sodium carbonate, potassium carbonate, sodium triphosphate, potassium triphosphate, sodium silicate and potassium silicate, for example, are included among the alkalis which are used to adjust the pH value.

Additives include compounds such as boric acid and borax; development inhibitors such as sodium bromide, potassium bromide and potassium iodide; organic solvents such as ethylene glycol, diethylene glycol, triethylene glycol, dimethylformamide, methylcellosolve, hexylene glycol, ethanol and methanol; and anti-foggants such as mercapto compounds like 1-phenyl-5-mercaptotetrazole and 2-mercaptobenzimida-zole-5-sulfonic acid, sodium salts, imidazole compounds like 5-nitroindazole, and benzotriazole compounds like 5-methylbenzotriazole. Furthermore, color toners, surfactants, antifoaming agents, hard water softening agents and film hardening agents may also be included as required. The amino compounds disclosed in JP-A-56-106244 and the imidazole compounds disclosed in JP-B-48-35493 are especially desirable from the viewpoint of accelerating development and increasing photographic speed.

As agents for preventing silver contamination, the compounds disclosed in JP-A-56-24347 can be used in the developers of the present invention, and the compounds disclosed in JP-A-62-212651 can be used as agents for preventing the occurrence of uneven development. Furthermore, the compounds disclosed in JP-A-61-267759 can be used as dissolution promotors.

Moreover, the boric acid disclosed in JP-A-62-186259 and the sugars (such as saccharose) disclosed in JP-A-60-93433, as well as oximes (such as acetoxime), phenols (such as 5-sulfosalicylic acid), and triphosphates (such as the sodium and potassium salts), for example, can be used as buffers in the developers of the present invention. Of these, boric acid is preferred.

As a fixer, aqueous solutions which contain film hardening agents (such as water soluble aluminum compounds) and acetic acid and dibasic acids (such as tartaric acid, citric acid and their salts), as required, may be used. The pH is preferably at least 3.8 and, most desirably, from 4.0 to 5.5.

Sodium thiosulfate and ammonium thiosulfate, for example, can be used as fixing agents, and the use of ammonium thiosulfate is especially desirable from the viewpoint of the fixing rate. The amount of fixing agent can be varied appropriately, but it is generally from about 0.1 mol/liter to about 5 mol/liter.

The water soluble aluminum salts which are used principally as film hardening agents are compounds which are generally known as film hardening agents for acid film hardening fixers, and examples include aluminum chloride, aluminum sulfate and potassium alum.

Tartaric acid or derivatives thereof, or citric acid or derivatives thereof, can be used individually or in combinations of two or more types as the dibasic acid referred to above. These compounds are effective when included in amounts of at least 0.005 mol per liter of fixer, and they are especially effective when used in amounts of from 0.01 mol/liter to 0.03 mol/liter.

Specific examples include tartaric acid, potassium tartrate, sodium tartrate, potassium sodiumtartrate, ammonium tartrate and ammonium potassium tartrate.

Examples of citric acid and derivatives thereof which are effective in the present invention include citric acid, sodium citrate and potassium citrate.

Preservatives (such as sulfite and bisulfite), pH buffers (such as acetic acid and boric acid), pH controlling agents (such as ammonia and sulfuric acid), agents for improving image storage properties (such as potassium iodide) and chelating agents can be included, as required, in the fixer. In this case, the pH buffers are used in amounts of from 10 to 40 grams/per liter, and preferably in amounts of from 18 to 25 grams/liter, since the pH of the developer is high.

As in the case of development, the fixing temperature and time are preferably from about 20° C. to about 50° C. and from 10 seconds to 1 minute.

Furthermore, fungicides (such as those disclosed in *The Chemistry of Biocides and Fungicides,* by Horiguchi, and in JP-A-62-115154), washing accelerators (for example sulfites), chelating agents and the like may be included in the wash water.

The photographic material which has been developed and fixed in the ways described above is washed with water and dried. The water washing is carried out in order to remove the silver salts which have been dissolved by the fixer, and it is preferably carried out at a temperature of from about 20° C. to about 50° C. for a period of from 10 seconds to 3 minutes. Drying is carried out at a temperature of from about 40° C. about 100° C., and the drying time is varied appropriately according to the state of the surroundings, but is generally from about 5 seconds to 3 minutes 3 seconds.

The method of processing, in accordance with the present invention, of the silver halide photographic photosensitive material of the present invention particularly suitable for rapid processing by use of an automatic processor. Automatic processors which can be used are any one of those which are of the roller or belt transport type, or other types.

The silver halide photographic photosensitive material of the present invention comprises at least one silver halide emulsion layer, in which layer the amount of silver is preferably not more than 3.2 g/m$^2$, and has excellent rapid processability such that a total dry to dry processing time is adjusted to be not more than 60 seconds, and preferably net more than 45 seconds.

Automatic processors of the roller transport type have been disclosed in U.S. Pat. Nos. 3,025,779 and 3,545,971, and these are referred to simply as roller transport type processors in the present specification. A roller transport type processor involves the four processes of development, fixation, water washing and drying but, even in the method of the present invention, other processes (such as a stop process for example) are not excluded. However, the execution of the four processes is most desirable. Here, less water is achieved in the water washing process by using a two or three stage counter-flow water washing system.

The developer which is used in the present invention is preferably protected with a covering which has a low oxygen permeability as disclosed in JP-A-61-73147. Furthermore, the developer which is used in the present invention is preferably used with a replenishment system as disclosed in JP-A-62-91939.

The silver halide photographic photosensitive material of the present invention has a high $D_{max}$ and, therefore, cases where these materials are subjected to a reduction treatment after image formation, a high density is retained even when the screen dot area is reduced.

No particular limitation is imposed upon the reducer which is used in the present invention and, for example, as well as those described on pages 738–744 of *The Theory of the Photographic Process,* by Mees, (1954, Macmillan) and on pages 166–169 of *Photographic Processing, Theory and Practice,* by Yano (1978, Koritsu Shuppan), those disclosed, for example, in JP-A-50-27543, JP-A-52-68429, JP-A-55-17123, JP-A-55-79444, JP-A-57-10140, JP-A-57-142639 and JP-A-61-61155 can be used. More specifically, reducers which contain permanganates, persulfates, ferric salts, cupric salts, ceric salts, ferricyanides, dichromates and the like, either individually or conjointly, as oxidizing agents, and which also contain, as required, inorganic acids such as sulfuric acid and alcohols, and reducers which contain oxidizing agents such as ferricyanides and ethylenediamine tetra-acetic acid ferric salts, silver halide solvents such as thiosulfates, thiocyanates, thiourea or derivatives thereof, and inorganic acids, as required, can be used.

Typical examples of reducers which can be used in the present invention include the so-called Farmer's reducer, ethylenediamine tetra-acetic acid ferric salt, potassium permanganate and ammonium sulfate reducer (Kodak R-5) and ceric salt reducer.

The conditions for the reduction process are preferably such that in general the reduction is completed within a period of from a few seconds to a few tens of minutes, and especially within a few minutes at a temperature of 10° C. to 40° C., and preferably 15° C. to 30° C. A satisfactorily wide reducing latitude can be obtained within the range of these conditions if a sensitive material for plate making purposes of the present invention is being used.

The reducer acts upon the silver image which has been formed in an emulsion through a non-photosensitive upper layer which contains a compound of the present invention.

Reduction can be achieved in practice in various ways, for example, the sensitive material for plate making purposes may be immersed in the reducer and the liquid may be agitated, or reducer may be applied to the surface of the sensitive material for plate making purposes using a brush or a roller, for example.

The invention is described in practical terms below by means of illustrative examples, but the invention is not limited by these examples. Unless otherwise indicated, all parts, percents, ratios and the like are by weight.

ILLUSTRATIVE EXAMPLES

EXAMPLE 1

Preparation of Emulsions

Emulsion A

An aqueous solution of silver nitrate and an aqueous solution of sodium chloride which contained $4\times10^{-5}$ mol, per mol of silver, of $(NH_4)_2Rh(H_2O)Cl_5$ were added simultaneously over a period of 3 minutes to an aqueous gelatin solution which contained 5,6-cyclopentane-4-hydroxy-1,3,3*a*,7-tetra-azaindene ($5\times10^{-3}$ mol per mol of silver) which was being maintained at 40° C., and 0.08 μm core grains were prepared by controlling the potential to 95 mV during this period. Subsequently, an aqueous solution of silver nitrate and an aqueous solution of sodium chloride which contained $1.2\times10^{-4}$ mol, per mol of silver, of $(NH_4)_2Rh)H_2O)Cl_5$ were added simultaneously over a period of 7 minutes and cubic silver chloride grains having an average grain size of 0.10 μm were prepared by controlling the potential during this period to 95 mV.

Emulsion B

Cubic silver chloride grains having an average grain size of 0.15 μm were obtained in the same way as in the preparation of emulsion A except that the addition times for the aqueous silver nitrate solutions and sodium chloride solutions were modified to 7 minutes and 14 minutes, respectively.

Emulsion C

Cubic silver halide grains having an average grain size of 0.22 μm were prepared in the same way as in the preparation of emulsion A except that the temperature during the preparation was held at 42° C., and the addition times of the aqueous silver nitrate solutions and the sodium chloride solutions were modified to 14 minutes and 28 minutes, respectively.

Preparation of Coated Samples

The compound of formula $C_{16}H_{33}O(CH_2CH_2O)_{25}H$ (50 mg/m$^2$), 24 mg/m$^2$ of 5,6-cyclopentane-4-hydroxy-1,3,3*a*,7-tetra-azaindene, 5 mg/m$^2$ of 5-methyltriazole, 770 mg/m$^2$ of ethyl acrylate latex (having an average particle size of 0.05 μm), 3 mg/m$^2$ of the compound indicated below and 126 mg/m$^2$ of 2-bis(vinylsulfonylacetamido)ethane as a film hardening agent were added to the abovementioned emulsions and the mixture was coated on a polyester base in such a way as to provide 3.0 g/m$^2$ of silver. The gelatin weight was 1.1 g/m$^2$.

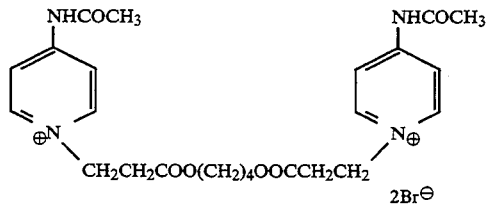

A lower protective layer consisting of 0.6 g/m$^2$ of gelatin, 5 mg/m$^2$ of 5-nitroindazole 8 mg/m$^2$ of lipoic acid, 6 mg/m$^2$ of $C_2H_5SO_2SNa$, 50 mg/m$^2$ of hydroquinone, 15 mg/m$^2$ of 1-hydroxy-2-benzaldoxime and 230 mg/m$^2$ of ethyl acrylate latex (average particle size 0.05 μm), and an upper protective layer consisting of 0.5 g/m$^2$ of gelatin, 55 mg/m$^2$ of matting agent (silicon dioxide, average particle size 3.5 μm), 135 mg/m$^2$ of methanol silica (average particle size 0.02 μm) and, as coating promotor, 25 mg/m$^2$ of sodium dodecylbenzenesulfonate, 20 mg/m$^2$ of the sodium salt of the sulfate ester of poly(degree of polymerization 5)oxyethylene nonylphenyl ether and 3 mg/m$^2$ of N-perfluorooctanesulfonyl-N-propylglycine, potassiumsalt, were coated at the same time over the emulsion layer and, also at the same time, 0.5 g/m$^2$ of gelatin, 50 mg/m$^2$ of polystyrenesulfonic acid, K+ salt, 50 mg/m$^2$ of ethyl acrylate latex and a solid dispersed dye of the present invention, as indicated in Table 1, were coated as an antihalation layer between the emulsion layer and the base layer, and samples were obtained in this way.

The base used in this illustrative example had a backing layer and a backing protective layer of which the compositions are indicated below. (The swelling factor of the backing side was 110%.)

| | |
|---|---|
| Backing Layer | |
| Gelatin | 170 mg/m$^2$ |
| Sodium dodecylbenzenesulfonate | 32 mg/m$^2$ |
| Sodium dihexyl-α-sulfosuccinate | 35 mg/m$^2$ |
| $SnO_2$/Sb (9/1 by weight, average particle size 0.25 μm) | 318 mg/m$^2$ |
| Backing Protective Layer | |
| Gelatin | 2.7 g/m$^2$ |
| Silicon dioxide matting agent (average particle size 3.5 μm) | 26 mg/m$^2$ |
| Sodium dihexyl-α-sulfosuccinate | 20 mg/m$^2$ |
| Sodium dodecylbenzenesulfonate | 67 mg/m$^2$ |
| $C_8F_{17}SO_2N(C_3H_7)-(CH_2CH_2O)_n-(CH_2)_4-SO_3Li$ | 5 mg/m$^2$ |
| Dye B 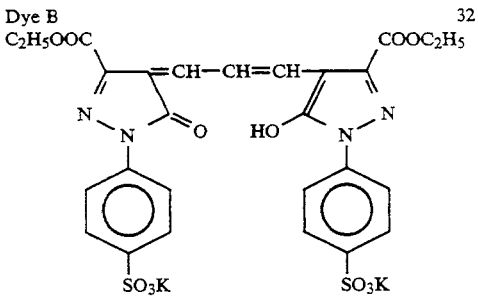 | 32 mg/m$^2$ |
| Dye C 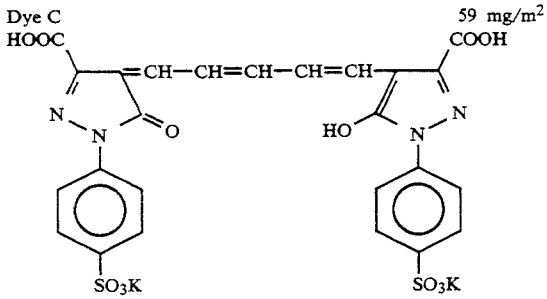 | 59 mg/m$^2$ |
| Ethyl acrylate latex (average particle size 0.05 μm) | 260 mg/m$^2$ |
| 1,3-Divinylsulfonyl-2-propanol | 149 mg/m$^2$ |

The water soluble dyes shown in Table 1 were coated.

Performance Evaluation

The samples obtained in this way were exposed through a contact halftone original and an optical wedge using a P-627FM printer (mercury lamp) made by the Dainippon Screen Co., developed for 20 seconds at 38° C. using LD-835 developer and an FG800RA processor made by the Fuji Photographic Film Co., fixed, washed with water and dried. Each of the samples was evaluated in the following manner.

1) $D_{max}$

The film (halftone original) on which a halftone image had been formed and which had been fixed, with an adhesive tape, onto a paste-up base, was brought into close contact with a film sample in such a way that the protective layer of the film sample faced the above halftone original. The maximum blackening density obtained when the film sample was exposed through the optical wedge to a 50% dot area of the contact halftone original with an exposure to produce a 50% dot area on the film sample was taken for $D_{max}$.

2) Gradation (1.5−0.1/-{log (exposure density which gives density 0.1)−log(exposure which gives density 1.5 )} 3) Exposure Speed A film sample was exposed from the reverse side using the same halftone original as used in the method of evaluating $D_{max}$. An exposure to produce a 50% dot area from a 50% dot area of the contact halftone original was expressed as a relative value to an exposure to produce the same dot area produced when the film sample was exposed from the face. 4) Dry Dot Suitability An Ugura Offset Test Keil (or Wedge) 1982 (made by Kohan Co.) was used to measure the dry dot suitability of the film samples as set forth below.

A spread value of the dots produced from a 50% dot area of the Test Keil on a film sample was measured when the dots produced from a 50% dot area of the Test Keil on the film sample were allowed to spread until a 50% dot area of the Test Keil were produced on the film sample such that an image produced from a 95% dot area of the Test Keil had no space between the dots. For example, when a 50% dot area is spread to produce a 65% dot area and an image produced from a 95% dot area had no space between the dots, a spread value is expressed as being 15%. Larger spread values indicate better Dry Dot Suitability, with spread values of not less than 20% being desirable. 5) Residual Coloration Unexposed film was processed under the development conditions described above. The temperature of the wash water was set to 10° C. Evaluations were carried out by grading according to five ranks, with a score of "5" for the best and a score of "1" for the worst. Scores of "3" and above are suitable for practical use.

As is clear from Table 1, samples (4)-(9), (16) and (17) of the present invention had a high $D_{max}$ and good dry dot suitability, a high photographic speed on exposing from the reverse side and they were good with respect to the residual coloration.

TABLE 1

| Sample No. | Emulsion | Solid Dispersed Dye in the AH Layer: Compound No. | Solid Dispersed Dye in the AH Layer: Amount Added (mg/m²) | Water Soluble Dye Added to the BC Layer: Amount Added (mg/m²) | Water Soluble Dye Added to the BC Layer: Absorbance (at 360 nm) | Photographic Performance: Dmax | Photographic Performance: Gradation | Photographic Speed on Exposure from the Reverse Side | Dry Dot Suitability | Residual Coloration | |
|---|---|---|---|---|---|---|---|---|---|---|---|
| 1 | A | — | — | 200 | 0.55 | 5.8 | 8.7 | 50 | 10% | 5 | |
| 2 | " | — | — | 400 | 0.90 | " | " | 35 | 13% | 4 | |
| 3 | " | — | — | 600 | 1.62 | " | " | 20 | 17% | 3 | |
| 4 | " | III-1 | 30 mg | 100 | 0.40 | " | " | 71 | 21% | 5 | This Invention |
| 5 | " | " | " | 200 | 0.55 | " | " | 47 | 22% | 5 | |
| 6 | " | " | 60 mg | 100 | 0.40 | " | " | 56 | 23% | 4 | |
| 7 | " | " | " | 200 | 0.55 | " | " | 40 | 24% | 4 | |
| 8 | " | I-1 | " | 100 | 0.40 | " | " | 63 | 21% | 4 | |
| 9 | " | III-5 | " | " | " | " | " | 66 | " | 4 | |
| 10 | " | III-1 | 90 mg | — | — | " | " | 58 | 22% | 1 | |
| 11 | " | " | " | 100 | 0.40 | " | " | 50 | 25% | 1 | |
| 12 | " | I-1 | " | " | " | " | " | 58 | 24% | 1 | |
| 13 | " | III-5 | " | " | " | " | " | 60 | 23% | 1 | |
| 14 | B | III-1 | — | 400 | 0.90 | 5.5 | 7.9 | 35 | 14% | 4 | |
| 15 | " | " | — | 600 | 1.62 | " | " | 20 | 18% | 3 | |
| 16 | " | " | 30 mg | 100 | 0.40 | " | " | 71 | 23% | 5 | This Invention |
| 17 | " | " | 60 mg | " | " | " | " | 56 | 25% | 4 | |
| 18 | " | " | 90 mg | " | " | " | " | 50 | 26% | 1 | |
| 19 | C | — | — | 200 | 0.55 | 4.7 | 5.6 | 50 | 20% | 5 | |
| 20 | " | — | — | 400 | 0.90 | " | " | 35 | 22% | 4 | |
| 21 | " | III-1 | 30 mg | 100 | 0.40 | " | " | 69 | 24% | 5 | |
| 22 | " | " | 90 mg | " | " | " | " | 54 | 26% | 1 | |

EXAMPLE 2

Emulsion D was prepared in the same way as Emulsion A except that the transition metal was changed to $K_2Ru(NO)Cl_5$. Coating as set forth in Table 2 was carried out in the same way as in Example 1 except that the dye (1) was added to the emulsion layer as shown in Table 2, and samples were processed with a development time of 15 seconds at 38° C. with the developer, of which the formulation is indicated below, using an FG-710NH automatic processor made by the Fuji Photographic Film Co. Evaluations were made in the same way as in Example 1. The results are shown in Table 2.

Moreover, the evaluation of tone reproduction and variability was carried out using the methods described below.

The Ugura Offset Test Keil used for measuring the dry dot suitability in Example 1 was used to measure the tone reproduction and tone variability of the film samples as set forth below.

1) Tone Reproduction

The tone reproduction of the dots ranging from the smallest dots to the largest dots of the Test Keil was evaluated at the time when a 50% dot area was produced, by contact work, from a 50% dot area of the Test Keil.

2) Tone Variability

Tone variability was expressed by % by area of the dots produced, by contact work, from a 50% dot area of the Test Keil when a film sample was exposed with an exposure which was four times as much as the exposure to produce, by contact work, a 50% dot area from a 50% dot area of the Test Keil.

3) Reduction in Photographic Speed (ΔlogE) When the Water Soluble Dye (1) Was Added The samples were exposed through an optical wedge using a P-627FM printer made by the Dainippon Screen Co., developed under the developing conditions described above and the difference in the logarithm of the exposure which gave a density of 0.1 was obtained.

As is clear from Table 2, the dry dot suitability improved when the weight of silver was increased but there was a marked deterioration in residual coloration on rapid processing. Furthermore, with samples (31) and (32) to which water soluble dyes had been added and the reduction in speed was within 0.2, the tone reproduction and variability were good.

TABLE 2

| Sample No. | Weight of Silver (g/m²) | Solid Dispersed Dye in the AH Layer: Compound No. | Solid Dispersed Dye in the AH Layer: Amount Added (mg/m²) | Water Soluble Dye (1): Amount Added (mg/m²) | Water Soluble Dye (1): Δ log E | Dmax | Dry Dot Suitability | Tone Reproduction | Tone Variability | Residual coloration | |
|---|---|---|---|---|---|---|---|---|---|---|---|
| 23 | 2.5 | III-1 | 30 | — | — | 5.1 | 20 | 1%~99% | +6% | 5 | |
| 24 | 3.0 | " | " | — | — | 5.8 | 22 | " | " | 5 | |
| 25 | 3.5 | " | " | — | — | >6 | 24 | " | " | 3 | |
| 26 | 4.0 | " | " | — | — | >6 | 25 | " | " | 1 | |
| 27 | 2.5 | " | 60 | — | — | 5.1 | 22 | " | " | 5 | |
| 28 | 3.0 | " | " | — | — | 5.8 | 24 | " | " | 4 | |
| 29 | 3.5 | " | " | — | — | >6 | 26 | " | " | 2 | |
| 30 | 4.0 | " | " | — | — | >6 | 27 | " | " | 1 | |
| 31 | 3.0 | " | " | 10 | −0.07 | 5.8 | 22 | 0.5~99.5 | " | 5 | This invention |
| 32 | " | " | " | 15 | −0.12 | " | 23 | " | " | 5 | |
| 33 | " | " | " | 30 | −0.25 | " | 23 | " | +4% | 5 | |

TABLE 2-continued

| Sample No. | Weight of Silver (g/m²) | Solid Dispersed Dye in the AH Layer: Compound No. | Solid Dispersed Dye in the AH Layer: Amount Added (mg/m²) | Water Soluble Dye (1): Amount Added (mg/m²) | Δ log E | Dmax | Dry Dot Suitability | Tone Reproduction | Tone Variability | Residual coloration |
|---|---|---|---|---|---|---|---|---|---|---|
| 34 | " | " | " | 50 | −0.30 | " | 23 | " | +3% | 5 |

Water Soluble Dye (1)

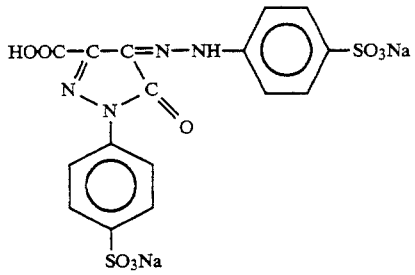

Developer Formulation

| | |
|---|---|
| 1-Hydroxyethylidene-1,1-diphosphonic acid | 2.0 grams |
| Diethylenetriaminepentaacetic acid | 2.0 grams |
| Sodium Carbonate | 10.0 grams |
| Potassium sulfite | 100.0 grams |
| Potassium bromide | 10.0 grams |
| Diethylene glycol | 20.0 grams |
| 5-Methylbenzotriazole | 0.2 grams |
| Hydroquinone | 46.0 grams |
| 4-Hydroxymethyl-4-methyl-1-phenyl-3-pyrazolidone | 1.0 gram |
| Sodium 2-mercaptobenzimidazole-5-sulfonate | 0.3 grams |
| Potassium hydroxide and water added | |

The pH was adjusted to 10.7 by adding potassium hydroxide and water to make 1 liter.

With the present invention, it is possible to economize the amount of silver used and achieve good dry dot suitability. It is also possible to achieve good tone variability and tone reproduction by fixing 10–80 mg of a solid dispersed dye in an antihalation layer and adding a water soluble dye or a solid dispersed dye which has an absorbance at 340–380 nm in the range 0.30–0.90, in the backing layer.

While the invention has been described in detail and with reference to specific embodiments thereof, it will be apparent to one skilled in the art that various changes and modifications can be made without departing from the spirit and scope thereof.

What is claimed is:

1. A silver halide photographic photosensitive material comprising a support, at least one silver halide emulsion layer provided on said support, a non-photosensitive hydrophilic colloid layer provided between said support and said at least one silver halide emulsion layer, and a backing layer containing a dye provided on the side of said support which is opposite to the side having said at least one silver halide emulsion layer; wherein (a) said at least one silver halide emulsion layer contains silver halide grains having an average grain size of not more than 0.2 μm, and a silver chloride content of at least 90 mol %.

(b) said non-photosensitive hydrophilic colloid layer contains a dye which is solid-dispersed in the form of fine crystals and is coated in an amount of from 10–80 mg/m², and (c) said dye contained in said backing layer has an absorbance at 340–380 nm from 0.30–0.90.

2. A silver halide photographic photosensitive material as in claim 1, wherein the silver in said at least one silver halide emulsion layer is coated in an amount of not more than 3.2 g/m².

3. A silver halide photographic photosensitive material as in claim 1, wherein said at least one silver halide emulsion layer further contains a dye which has been solid dispersed in the form of fine crystals or a water soluble dye in such an amount that the photographic speed in terms of log E is not reduced by not less than 0.2.

4. A silver halide photographic photosensitive material as in claim 1, wherein said dye, which is solid-dispersed in the form of fine crystals in said non-photosensitive hydrophilic colloid layer, has a peak absorption in the range of 300–500 nm.

5. A silver halide photographic photosensitive material as in claim 1, wherein said dye, which is solid-dispersed in the form of fine crystals in said non-photosensitive hydrophilic colloid layer, is coated in an amount of from 20–60 mg/m².

6. A silver halide photographic photosensitive material as in claim 1, wherein said dye contained in said backing layer has an absorbance at 340–380 nm of from 0.4–0.8.

7. A silver halide photographic photosensitive material as in claim 1, wherein said at least one silver halide emulsion layer contains silver halide grains having an average grain size of from 0.08–0.16 μm.

8. A silver halide photographic photosensitive material as in claim 1, wherein said silver halide grains comprise a transition metal coordination complex.

9. A silver halide photographic photosensitive material as in claim 8, wherein the transition metal coordination complex contains a transition metal in an amount of at least $1\times10^{-7}$ mol.

10. A silver halide photographic photosensitive material as in claim 1, wherein said silver halide grains have an average grain size of 0.08–0.16 μm.

11. A method of processing a silver halide photographic photosensitive material, said method comprising processing said silver halide photographic photosensitive material with a total dry to dry processing time of 30–60 seconds, and wherein said silver halide photographic material comprises a support, at least one silver halide emulsion layer on said support, a non-photosensitive hydrophilic colloid layer provided between said support and said at least one silver halide emulsion layer, and a backing layer containing a dye provided on the side of said support which is opposite to the side having said at least one silver halide emulsion layer; wherein (a) said at least one silver halide emulsion layer contains silver halide grains having an average grain size of not more than 0.2 μm, a silver chloride content of at least 90 mol %, and the silver in said at least one silver halide emulsion layer is coated in an amount of not more than 3.2 g/m$^2$, (b) said non-photosensitive hydrophilic colloid layer contains a dye which is solid-dispersed in the form of fine crystals and is coated in the amount of from 10–80 mg/m$^2$, and (c) said dye contained in said backing layer has an absorbance at 340–380 nm of from 0.30–0.90.

12. A method of processing a silver halide photographic photosensitive material as in claim 11, wherein said silver halide grains have an average grain size of 0.08–0.16 μm.

* * * * *